US005082556A

United States Patent [19]

Reese

[11] Patent Number: 5,082,556

[45] Date of Patent: Jan. 21, 1992

[54] SEPARATOR, FLOAT SHUT-OFF VALVE, AND ORIFICE METER MOUNTED AS A UNIT OF SKID

[76] Inventor: Martin W. Reese, 4280 Dillon Hills Dr., Nashport, Ohio 43830

[21] Appl. No.: 596,020

[22] Filed: Oct. 11, 1990

[51] Int. Cl.[5] ..... B01D 19/00

[52] U.S. Cl. ..... 210/90; 210/123; 210/241; 210/533; 55/167

[58] Field of Search ..... 210/90, 123, 241, 533; 55/167, 169; 166/267

[56] References Cited

U.S. PATENT DOCUMENTS 1,248,057 11/1917 Bailey ..... 172/230
3,578,077 5/1971 Glenn, Jr. et al. ..... 166/276 X
4,597,437 7/1986 McNabb ..... 166/79

*Primary Examiner*—Frank Spear
*Attorney, Agent, or Firm*—Sidney W. Millard

[57] ABSTRACT

In association with a hydrocarbon producing well, a unit is mounted to receive the discharge from the well. The unit includes a separation tank, a float shut-off valve, and a vertically oriented orifice meter.

20 Claims, 4 Drawing Sheets

SEPARATOR, FLOAT SHUT-OFF VALVE, AND ORIFICE METER MOUNTED AS A UNIT OF SKID

FIELD OF THE INVENTION

This invention relates to a combination of components mounted as a unit on a skid which includes a liquid-gas separator, a float shut-off valve, and an orifice meter for measuring the flow of hydrocarbon gas through the unit.

BACKGROUND OF THE INVENTION

Environmental concerns have modified the operating procedure and apparatus necessary for an oil well or a hydrocarbon gas-producing well by limiting the ability of the operator to dump undesirable liquid and solids on the land surface. In well-drilling and hydrocarbon-extracting operations, the materials delivered to the surface usually include liquid hydrocarbon, salt water, hydrocarbon gasses, and solid particles of debris. The usable parts of the flow from the well include the hydrocarbon liquid and the hydrocarbon gas. Gas is separated from the liquid because the gas may be sold without further treatment. The liquid must be stored in a suitable container or containers and removed from the well site for further processing.

Conventional oil well apparatus at a well site includes an oil storage tank, a separator and associated valves and piping. The patent to McNabb, No. 4,597,437, discloses a storage tank, a separator tank and other piping apparatus mounted as a unit on a frame to be transported to the well site.

Flow meters in the form of orifice meters have been around for many years and the patent to Bailey, No. 1,248,057, is illustrative. It shows a duct joined together by a pair of flanges, and between the flanges is clamped a plate having a centrally located orifice. Gas flows through the duct and through the orifice. Two openings are made in the duct, one on each side of the plate to measure the pressure differential. That gives a measure of how much gas passes the orifice plate in a period of time. Note that the orifice meter is oriented horizontally. The problem this creates is that liquid will collect in the horizontal pipe and back up at the upstream side of the orifice plate. That changes the duct cross-section and the flow characteristics of the gas passing through the duct and gives false readings.

SUMMARY OF THE INVENTION

This invention is concerned with providing a unit on a skid connected to the well-head of a hydrocarbon producing well. The unit includes components in sequence, (1) a separator for separating liquid from gas, (2) a float shut-off valve to prevent liquid from exiting to the gas distribution line, and (3) orifice meter means to measure the flow of separated hydrocarbon gas discharged from the unit.

The separator comprises a tank where the gas and liquid withdrawn from the well are dumped. Liquid falls by gravity to the bottom and gas rises to the top where it exits to a second and more refined separator. Retained liquid is usually a mixture of salt water and oil.

The system is designed to periodically drain the liquid from the separator into a large storage tank. Trucks and/or pipelines remove liquid from storage tanks for transportation to a processing center. Problems occur when the separator is not timely drained and the liquid overflows downstream. Since the downstream pipe connections eventually deliver to a natural gas distribution system, liquid hydrocarbons will clog the system. This invention provides a second separator in the form of a float shut-off valve immediately downstream of the first separator. The second separator has a prime function of sealing off the downstream distribution system from liquid when the first separator overflows. The second separator has a secondary function of collecting liquid droplets and small particles of debris entrained in the gas flow from the first separator.

This stream of gas exiting the first separator is directed to an inlet of the float shut-off valve. The shut-off valve includes a reservoir which is designed to collect droplets of entrained water and hydrocarbon liquids in the gaseous stream from the first separator and particles of solid debris as may be entrained in the stream. The reservoir and float valve are aligned vertically so that droplets collecting on the surfaces of the valve and vertically upwardly extending tubing will drain by gravity downward into the reservoir. Entrained solid particles entering the reservoir will also fall by gravity because the reservoir serves as a plenum chamber. A lightweight spherical ball is mounted in a porous tube within the reservoir and floats upward on the liquid as it collects. Eventually enough liquid collects in the reservoir until the level reaches the inlet pipe from the first separator. Where the outlet from the float valve is above the upper section of the first separator, liquid overflowing the reservoir through the float valve inlet will drain back into the first separator.

Where liquid overflows from the first separator into the reservoir because the first separator is full of liquid, the inflowing liquid will raise the ball in the reservoir into contact with the downstream reservoir outlet to seal the outlet from fluid flow through the float valve.

The diameter of the porous tube in the reservoir is greater than the diameter of the spherical ball which allows the ball to float upward without obstruction. However, the outlet port from the float valve is circular and smaller in diameter than the diameter of the ball. Thereby, when the liquid level rises to near the top of the reservoir, it pushes the spherical ball against the edges of the outlet and seals the valve. That causes flow to cease until the reservoir is drained and the ball can recede. Thereby, no liquid escapes into the gas distribution system.

The orifice meter of this invention is downstream of the float shut-off valve and is uniquely structured for compactness and improved operation of the portable unit, in that, it is vertically mounted. That is, the ductwork of the orifice meter is aligned with an axis which extends vertically. Flow measuring systems are not modified, the modifications are the orientations of the orifice plate and the piping on each side of the orifice plate. The plate forming the orifice is aligned horizontally. Thus, when any liquid or solid debris escapes the reservoir of the float shut-off valve it falls vertically to the upstream side of the orifice plate and is then sucked right on through the orifice. Thereby, a build-up of liquid along the upstream side of the orifice meter is prevented. Accordingly there is no modification of the flow characteristics due to reduced cross-sectional area in the duct on the upstream side of the orifice meter.

Objects of the invention not clear in the above will be abundantly clear upon a review of the drawings and the description of the preferred embodiments which follow.

DESCRIPTION OF THE PREFERRED EMBODIMENTS

Figure 1:
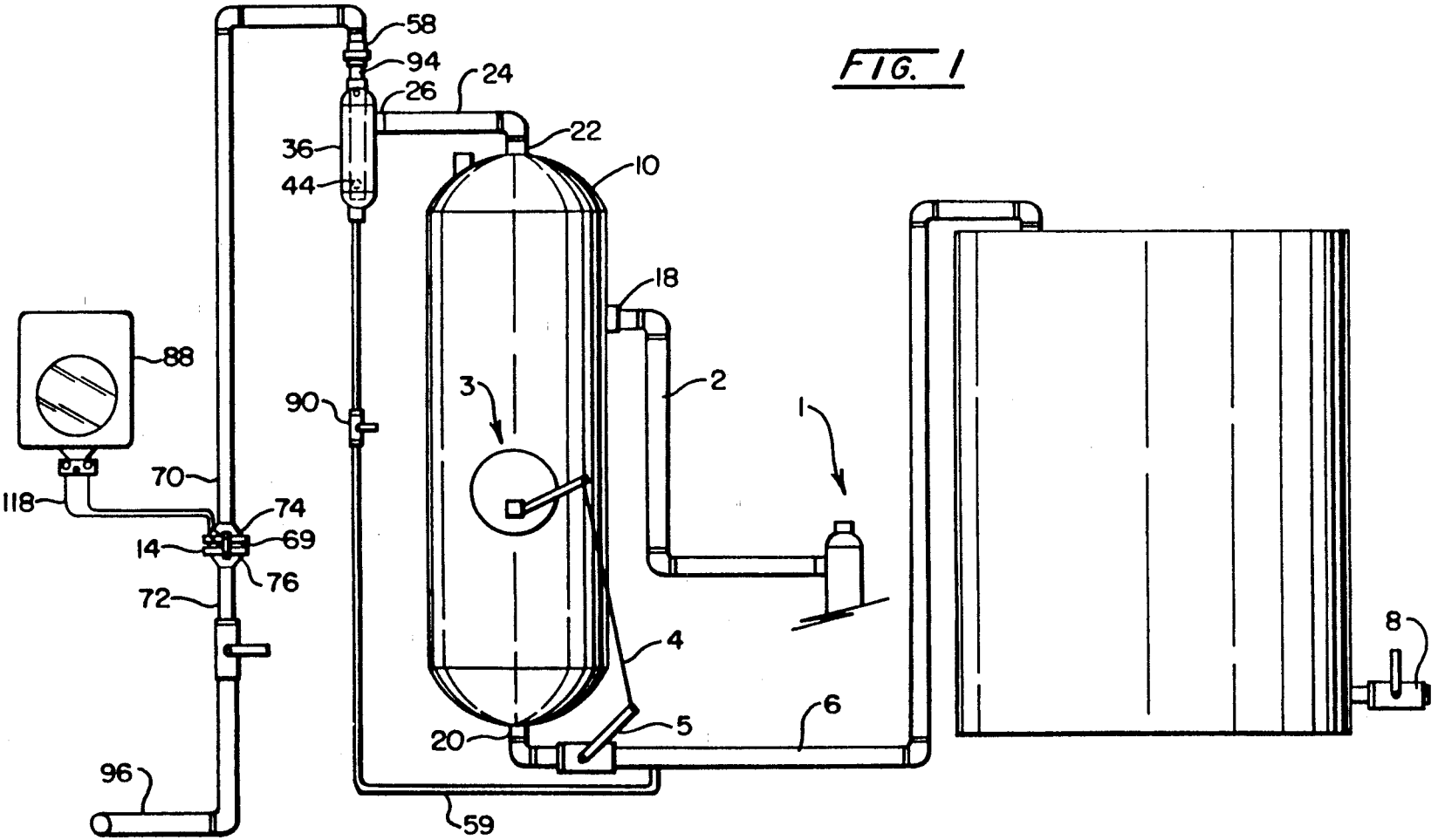
FIG. 1 is a flow diagram of the combination of this invention located at a well-head.

Looking to FIG. 1, the apparatus of this invention will be located adjacent an oil and gas well-head 1. Tubing 2 connects well-head 1 with the separator tank 10 through an inlet 18. Gas, oil and water flash into the separator 10 and because of the volume and relatively quiescent atmosphere, most oil, water and entrained particles of solid debris will settle by gravity to the lower section. Gas, primarily methane, will rise to the upper section of the separator and pass by exit 22 into duct 24.

As the level of liquid rises in separator tank 10 it will eventually activate a first float valve 3. Float valve 3 is mechanically connected at 4 to valve actuator handle 5. A rising liquid level causes float valve 3 to rotate valve handle 5 to open the fluid drain 20 at the bottom of separator tank 10 and drain liquid through duct 6 into a large storage tank 7. Gas pressure from the system will assist in forcing the liquid out through drain 20.

Storage tank 7 may be discharged through valve 8 into a tank truck or a pipeline as needed.

Figure 2:
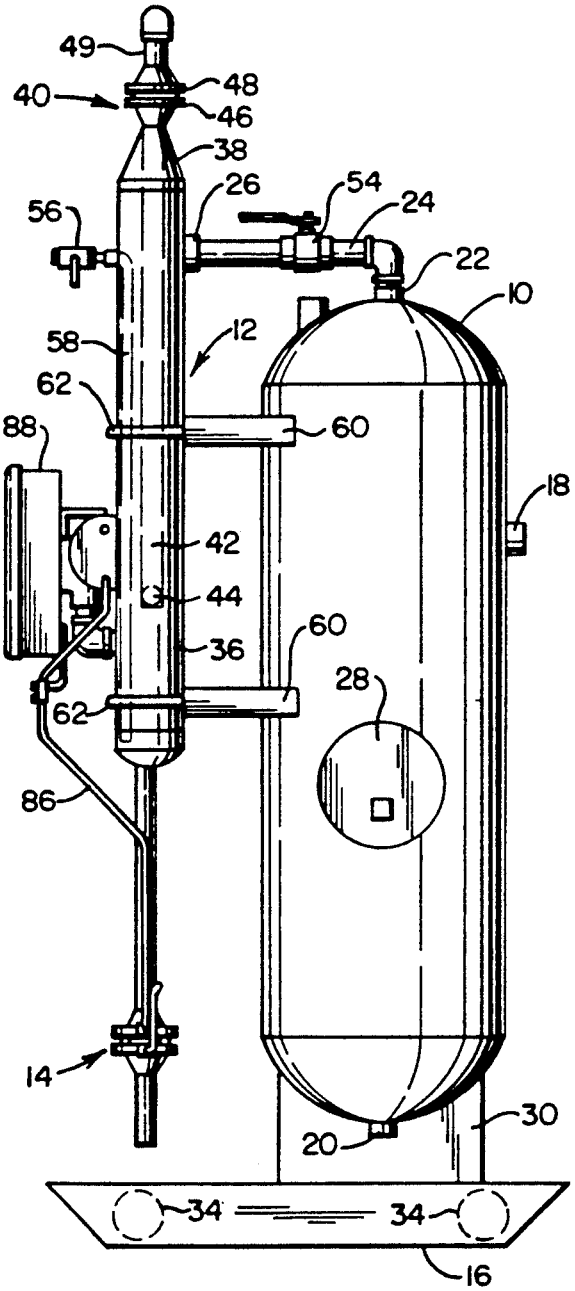
FIG. 2 is a side elevational view of the combination of this invention mounted on a skid.

FIG. 2 illustrates the combination of a separator-storage tank 10, a drip float shut-off valve 12, and an orifice meter 14, all mounted on a skid 16 as a unit.

During the course of operations, there are occasions when access to the inside of tank 10 is necessary for cleaning an inspection. Access to the interior of the tank is available through covered port 28.

Tank 10 is maintained in stable position on skid 16 by vertically extending plates 30, which are welded or otherwise mechanically secured to the bottom of tank 10 and to parallel H-beams 32 which form the side edges of the skid 16. Cross beams 34 are secured between H-beams 32 for mechanical stability. On some occasions, diagonally extending cross beams might also be appropriate between beams 34, but they are not shown in the illustrated embodiment.

Separated gaseous materials are discharged from the top of the upper section of the separator 10 through exit 22 and conducted by suitable tubing or ductwork 24 to an inlet 26 into float shut-off valve 12, which will be explained in more detail subsequently. Note that in the illustrated embodiment, inlet 26 to the float shut-off valve 12 is elevated above the exit 22 from the first separator tank 10.

Figure 4:
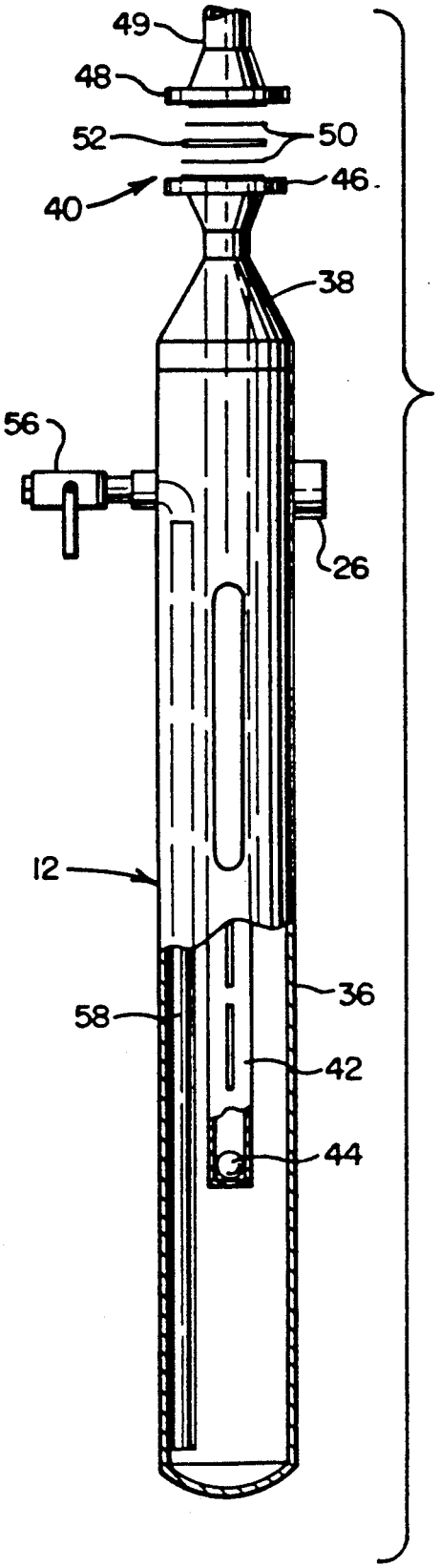
FIG. 4 is an enlarged elevational view of one embodiment of the float valve of this invention.

Looking now to FIG. 4, the second separator or float valve 12 is designed to collect any residual liquid or solid particles which may be exhausted from the tank 10 through ducting 24. It does this through the concept of a plenum chamber, the same concept as is used in tank 10. The float valve includes an elongated reservoir 36, preferably about six inches in diameter and closed at the bottom. Inlet 26 is located near the top, the top being a cone-shaped structure 38 leading to a float valve outlet 40.

Within the reservoir 36 is a perforated tube 42, preferably about two inches in diameter, co-axially aligned with outlet 40. It extends from near the bottom of the reservoir into the outlet 40. Preferably the perforations in tube 42 are slots about one inch wide by fourteen inches in length. The perforated tube 42 is closed at the bottom to contain a spherical fluid float ball 44, preferably about 1½ inches in diameter.

At the float shut-off valve outlet 40 is a flange 46 which is bolted to a correspondingly shaped flange 48 on outlet ducting 49. Between the two flanges 46 and 48 are a pair of sealing gaskets 50 sandwiching an orifice plate 52, the orifice plate having an orifice about one inch in diameter.

Figure 3:
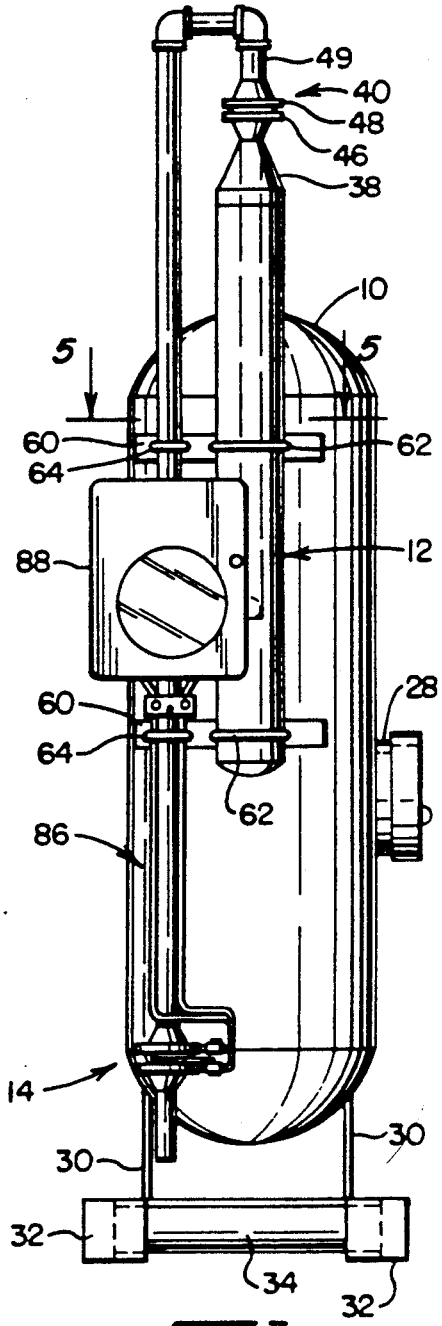
FIG. 3 is a left-hand side elevational view of FIG. 2.

During normal operation, droplets of water and hydrocarbons which collect on the walls and other float shut-off valve parts will drain down into the reservoir 36 and the reservoir will slowly fill with liquid. Float ball 44 is of a density less than the liquid being collected and as a consequence, it floats upward in tube 42 when the liquid level rises. The relative cross-sectional dimensions between the ball 44 and the perforated tube 42 are such that the ball does not hang up along the route from its position as illustrated in FIG. 3 to the top of tube 42. When the rising liquid reaches above the highest level of duct 24 it will overflow back into first separator 10. Normally the collected liquid in float shut-off valve 12 will be evacuated prior to the time it reaches the backward overflow level as will be explained subsequently but the designed elevation differentials provide a safety feature which will allow the system to continue to operate normally.

The primary function of the shut-off valve 12 is to prevent liquid from overflowing downstream into the system when it overflows tank 10 into reservoir 36. When that occurs the ball 44 rises with the liquid level into outlet 40 where it encounters the one inch diameter orifice in the orifice plate 52. Spherical ball 44 seals against the round orifice and stops flow out of the float shut-off valve. Such an event will occur if there is a malfunction of the drain system from tank 10 through drain 20, valve 5 and ducting 6.

At such time as ball 44 engages orifice plate 52, it will be necessary for workers to drain the liquid from the tank 10 and reservoir 36 before gas flow can resume. Procedurally, the following sequence is used. First, as best seen in FIG. 1, the cut-off valve 54 in ductwork 24 is closed. Then, as best seen in FIG. 4, blow-off valve 56 from the reservoir 36 is opened. Back pressure in ducting 49, downstream of flange 48, pushes ball 44 out of contact with orifice plate 52 when blow-off valve 56 is opened. Thereby, fluid in the reservoir 36 is forced from the bottom of the reservoir through discharge pipe 58 and ducting 59 into ducting 6 until the exiting fluid turns from liquid to gaseous, at which time blow-off valve 56 is closed and valve 54 between tank 10 and float shut-off valve 12 is reopened and operations will resume.

Obviously, as liquid is overflowing from tank 10, it will have to be drained also before valve 54 is reopened and normal operations can resume. If the automatic opening of valve 5 by first float valve 3 does not occur, valve 5 may be opened manually and back pressure will flush the liquid from the tank 10. A valve (not shown) in the piping 2 from well-head 1 to tank 10 may be closed during the manual draining operation to minimize the risk of excessive pressure. Note that the illustrated mechanical connection 4 between valves 3 and 5 may be mechanical, hydraulic or electrical, as desired.

Figure 5:
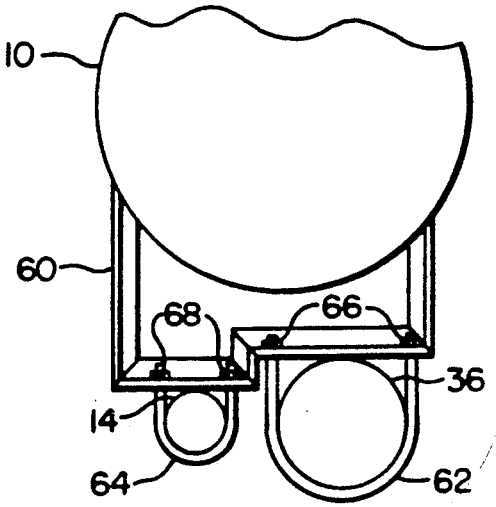
FIG. 5 is a fragmentary top plan view, partially in section, taken along line 5—5 of FIG. 3.

FIG. 5 illustrates a series of angle irons welded or otherwise mechanically secured to tank 10 to serve as stability brackets 60. Note in FIGS. 2 and 3 that there are two sets of vertically aligned brackets 60. Each bracket 60 is penetrated by a U-shaped clamp 62 which circumscribes reservoir 36. A similar U-shaped clamp 64 secures orifice meter 16. Clamps 62 and 64 are secured in place by nuts 66 and 68, respectfully.

Figure 7:
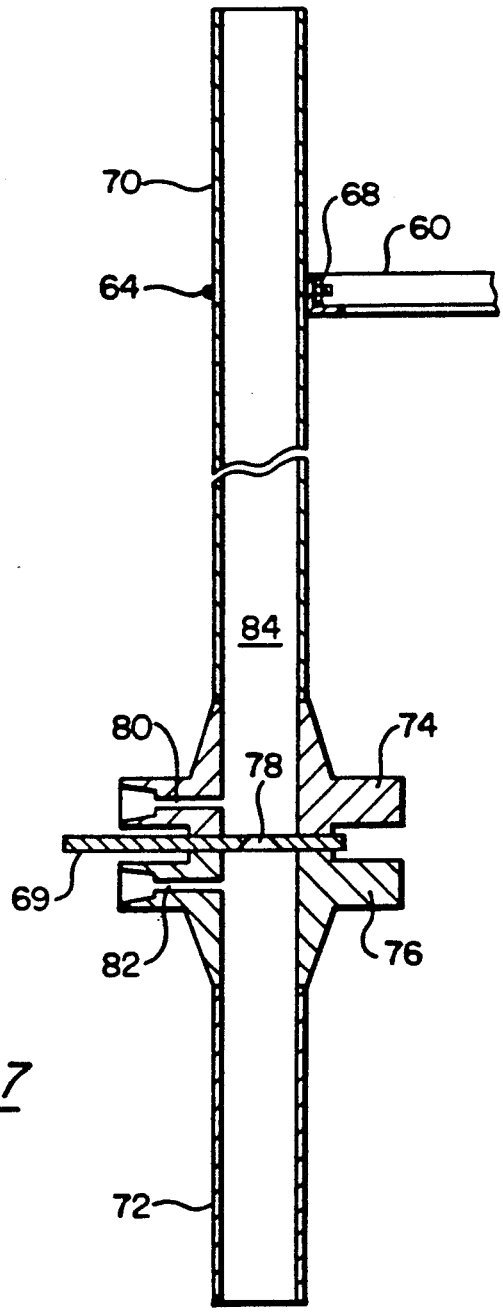
FIG. 7 is a side elevational view in section of the vertically aligned orifice meter.

Looking to FIG. 7, orifice meters require a prescribed length of straight piping leading to the orifice plate 69 to operate correctly by industry standards, and such a length 70 is provided. That is also true of the downstream piping 72.

Orifice plate 69 is sealingly clamped between a pair of flanges 74 and 76 in conventional fashion. The orifice 78 in plate 69 is of a specified size depending upon factors at the well site. Note that orifice 78 diverges in cross-sectional area in the downstream direction as shown in FIG. 7.

Pressure taps 80 and 82 are in fluid communication with the flow path 84 of the hydrocarbon gaseous material and pass radially outward directly through the flanges 74, 76 themselves. Tubing, generally indicated at 86 (see FIGS. 2 and 3), leading from taps 80, 82 is in direct communication with an appropriate pressure recording unit 88 as is conventional and well-known in the art.

It will be noted that the orifice meter structure is oriented with the piping 70, 72 having a vertical axis and the orifice plate 69 being generally horizontal. Thereby, any liquid and/or solid particles which may be entrained in the gas flowing from float shut-off valve 12 through ductwork 70 falls on the horizontal orifice plate 69 and is drawn through the orifice 78 by the momentum of the flowing gas. What this feature accomplishes is preventing a liquid buildup upstream of the orifice plate, which buildup would modify the flow characteristics of the gas in flow path 84 and give false readings to the recording device 88. As will be clear to those having ordinary skill in the art, should the orifice meter be rotated ninety degrees from what is illustrated in FIG. 7, liquid trapped on the upstream side of orifice plate 66 slowly collects and rises to the level of the orifice opening 78 before any liquid is drawn through the orifice. Thereby, the meter readings taken from tap 80 are misleading because the cross-sectional area of gaseous flow in pipe 70 is not the diameter of the pipe 70 because of the liquid buildup. With this invention, the orifice plate 69 is horizontal, there is no liquid buildup and the cross-sectional area for gaseous flow remains constant.

Figure 6:
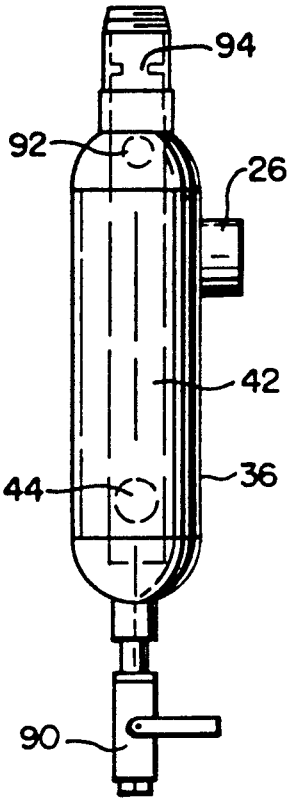
FIG. 6 is a side elevational view of an alternative embodiment for the float valve.

FIG. 6 illustrates an alternative embodiment for the float shut-off valve !2. It includes the same inlet 26, a reservoir 36, a perforated tube 42, and a float ball 44. However, the length of the reservoir 36 is much shorter and the blow off valve 90 is connected directly to the bottom of reservoir 36. Note also the holes 92 near the top of tube 42 to facilitate the exit of hydrocarbon gas from the float shut-off valve prior to the time the ball 44 seals against the orifice plate 94.

In operation, the combination of the liquid separation tank 10, float shut-off valve 12 and orifice meter 14 with its associated pressure recording apparatus 88 is transported to the well site on skid 16 as a unit. Inlet 18 to the separation tank 10 is connected directly to the ducting 2 leading from the well-head 1. Gas, salt water and oil may be delivered to tank 10. The majority of the water and oil will drop by gravity to the bottom of tank 10 and the gas will flow through exit 22 and ducting 24 to the reservoir 36 of float shut-off valve 12. The float cut-off valve structure, including the reservoir 36, is designed to separate those smaller droplets of liquid and solid particles entrained in the gaseous stream exiting tank 10. Those droplets and particles settle by gravity to the bottom of the reservoir 36. Hydrocarbon gas exits float valve 12 through ducting 49 and enters pipe 70 of the orifice meter 14. Pressure readings are obtained through pressure taps 80 and 82 on each side of orifice plate 69 and are recorded or otherwise measured by measuring unit 88, thereby giving a measured reading of the amount of hydrocarbon gas being discharged from the unit into whatever system 96 is decided by the user.

Having thus described the invention in its preferred embodiments, it will be clear to those having ordinary skill in the art that certain modifications may be made in this invention without departing from the spirit. The language used to describe these preferred embodiments should not be considered limiting on the invention. Rather, it is intended that the invention be limited only by the scope of the appended claims.

I claim:

1. In combination, a supply of gas connected by a first duct to a liquid separator tank, said tank having upper and lower sections, a second duct in fluid communication with the upper section of the tank extending into a drip collecting float shut-off valve, said valve having inlet and outlet openings, a third duct in fluid communication with said valve outlet and extending into an orifice meter, liquid and solid particles separating from gas in said separator tank and settling to the lower section, said valve including a reservoir, said reservoir serving as a repository for liquid and solid particles conveyed by said second duct through said valve inlet, said liquid and solid particles settle by gravity into said reservoir, a float ball in said reservoir, said ball being of less density than the liquid in said reservoir and said ball having a diameter greater than the valve outlet, said reservoir being configured to direct said ball toward said valve outlet as it floats on said liquid in said reservoir, said ball and valve outlet being configured to have the ball seal the valve outlet when the reservoir is full of liquid and solid particles, an outlet valve means for exhausting liquid and solid particles from said reservoir, and said orifice meter including said third duct having an axis, means forming an orifice in said third duct, said orifice having a cross-sectional area less than the cross-sectional area of said third duct, means for making pressure measurements in said third duct both upstream and downstream of said orifice means for preventing liquid from collecting in said third duct adjacent the upstream side of said orifice.

2. The combination of claim 1 wherein said means for preventing liquid from collecting in said duct adjacent the upstream side of said orifice comprises (1) mounting said third duct with its axis vertical and (2) mounting said orifice horizontal.

3. The combination of claim 2 wherein the means forming an orifice comprises a plate having a circular opening, means for mounting said plate in said third duct with said orifice co-axially aligned with said duct axis, said mounting means comprising a pair of flanges projecting radially of said third duct, means for clamping said plate between said flanges.

4. The combination of claim 3 wherein the means for making pressure measurements comprises a passage extending radially through each flange into fluid communication with the interior of said third duct, two tubes mounted adjacent said flanges, each passage being connected to one end of one of said pressure gauge tubes, the other end of each of the tubes being connected to pressure recording apparatus.

5. The combination of claim 4 wherein the combination is mounted as a unit on a skid, said skid including a pair of parallel H-beams, said beams being secured together by cross beams, said skid allowing said combination to be moved as a unit to the site of a hydrocarbon producing well.

6. The combination of claim 5 wherein the orifice in said plate expands in cross-sectional area from the upstream side to the downstream side.

7. The combination of claim 6 including stabilizing brackets connected between said tank and said third duct, one stabilizing bracket being connected to said third duct upstream of said plate and another stabilizing bracket being connected to said third duct upstream of said plate.

8. The combination of claim 7 wherein the configuration of said reservoir for directing the floating ball into sealing engagement with said valve outlet comprises a perforated tube mounted vertically in axial alignment with said valve outlet, said ball being mounted within said tube and having a diameter less than the diameter of the tube.

9. The combination of claim 1 wherein the configuration of said reservoir for directing the floating ball into sealing engagement with said valve outlet comprises a perforated tube mounted vertically in axial alignment with said valve outlet, said ball being mounted within said tube and having a diameter less than the diameter of the tube.

10. The combination of claim 9 wherein the combination is mounted as a unit on a skid, said skid including a pair of parallel H-beams, said beams being secured together by cross beams, said skid allowing said combination to be moved as a unit to the site of a hydrocarbon producing well.

11. The combination of claim 10 including stabilizing brackets connected between said tank and said third duct, one stabilizing bracket being connected to said third duct upstream of said plate and another stabilizing bracket being connected to said third duct upstream of said plate.

12. The combination of claim 2 wherein the configuration of said reservoir for directing the floating ball into sealing engagement with said valve outlet comprises a perforated tube mounted vertically in axial alignment with said valve outlet, said ball being mounted within said tube and having a diameter less than the diameter of the tube.

13. The combination of claim 12 wherein the means forming an orifice comprises a plate having a circular opening, means for mounting said plate in said third duct with said orifice co-axially aligned with said duct axis, said mounting means comprising a pair of flanges projecting radially of said third duct, means for clamping said plate between said flanges.

14. The combination of claim 13 wherein the means for making pressure measurements comprises a passage extending radially through each flange into fluid communication with the interior of said third duct, two tubes mounted adjacent said flanges, each passage being connected to one end of one of said pressure gauge tubes, the other end of each of the tubes being connected to pressure recording apparatus.

15. The combination of claim 14 wherein the orifice in said plate expands in cross-sectional area from the upstream side to the downstream side.

16. The combination of claim 1 wherein the means forming an orifice comprises a plate having a circular opening, means for mounting said plate in said third duct with said orifice co-axially aligned with said duct axis, said mounting means comprising a pair of flanges projecting radially of said third duct, means for clamping said plate between said flanges.

17. The combination of claim 16 wherein the means for making pressure measurements comprises a passage extending radially through each flange into fluid communication with the interior of said third duct, two tubes mounted adjacent said flanges, each passage being connected to one end of one of said pressure gauge tubes, the other end of each of the tubes being connected to pressure recording apparatus.

18. The combination of claim 17 wherein the orifice in said plate expands in cross-sectional area from the upstream side to the downstream side.

19. The combination of claim 1 wherein the combination is mounted as a unit on a skid, said skid including a pair of parallel H-beams, said beams being secured together by cross beams, said skid allowing said combination to be moved as a unit to the site of a hydrocarbon producing well.

20. The combination of claim 19 including stabilizing brackets connected between said tank and said third duct, one stabilizing bracket being connected to said third duct upstream of said plate and another stabilizing bracket being connected to said third duct upstream of said plate.

* * * * *

UNITED STATES PATENT AND TRADEMARK OFFICE

CERTIFICATE OF CORRECTION

PATENT NO. : 5,082,556

DATED : January 21, 1992

INVENTOR(S) : Martin W. Reese

It is certified that error appears in the above-identified patent and that said Letters Patent is hereby corrected as shown below:

In the title of the invention for "OF" read --ON A--. Column 2, line 63 for "is" read --are--; line 63 for "modification" read --modifications--; line 63 after "the" read --gas--; and line 65 after "meter" and before the period read --due to entrained liquid--. Column 3, line 9 after "invention" and before the semicolon read --, partially in section--; and line 13 after "valve" and before the semicolon read --of Fig. 4--. Column 4, line 51 for "1" read --2-- and delete "the". Column 5, line 57 for "!2" read --12--. Column 6, line 9 after "10" and before the period read --from the gaseous hydrocarbon--.

Signed and Sealed this

Twenty-seventh Day of April, 1993

*Attest:*

MICHAEL K. KIRK

*Attesting Officer*

*Acting Commissioner of Patents and Trademarks*